United States Patent [19]

Kajiwara et al.

[11] Patent Number: 4,618,838

[45] Date of Patent: Oct. 21, 1986

[54] IMPEDANCE ADJUSTING ELEMENT FOR A MICROSTRIP CIRCUIT

[75] Inventors: Tadashi Kajiwara; Akira Sato; Shinobu Tsurumaru, all of Kanagawa; Kenichiro Kumamoto, Tokyo, all of Japan

[73] Assignee: Sony Corporation, Tokyo, Japan

[21] Appl. No.: 700,915

[22] Filed: Feb. 12, 1985

[30] Foreign Application Priority Data

Feb. 27, 1984 [JP] Japan ..... 59-35788

[51] Int. Cl.[4] ..... H01P 5/00; H01P 1/00

[52] U.S. Cl. ..... 333/33; 333/263

[58] Field of Search ..... 333/33, 224, 235, 246, 333/263; 334/40, 41, 71, 78

[56] References Cited

U.S. PATENT DOCUMENTS

| | | | |
|---|---|---|---|
| 2,410,656 | 11/1946 | Herold | 333/33 |
| 2,794,174 | 5/1957 | Arditi et al. | 333/33 |
| 3,925,740 | 12/1975 | Steensma | 333/235 |
| 4,472,690 | 9/1984 | Hallford | 333/263 X |

FOREIGN PATENT DOCUMENTS

| | | | |
|---|---|---|---|
| 676133 | 2/1951 | United Kingdom | 333/235 |

*Primary Examiner*—Paul Gensler

*Attorney, Agent, or Firm*—Lewis H. Eslinger; Alvin Sinderbrand

[57] ABSTRACT

Impedance adjusting elements for a microstrip circuit of the kind employing a signal transmission line connected to an active circuit element and impedance matching elements, such as parallel-connected open-ended stubs, are formed of one or more wire elements arranged in proximity to the transmission line and the open-ended stub and connected at one end to the ground plane on the side of the substrate opposite the transmission line, wherein the free end of the wire elements can be freely moved, thereby adjusting the spacing of the wire elements from the respective signal path and open-ended stub and adjusting the angle of intersection of the wire elements and the respective signal path and open-ended stub, so that the effective impedances of the circuit can be controlled.

15 Claims, 5 Drawing Figures

IMPEDANCE ADJUSTING ELEMENT FOR A MICROSTRIP CIRCUIT

BACKGROUND OF THE INVENTION

1. Field of the Invention

This invention relates generally to a high frequency strip-line circuit and, more particularly, to a microstrip circuit for processing a microwave signal.

2. Description of the Prior Art

Transmitting and receiving information signals via satellite generally involves high-frequency signals in the microwave region of the frequency spectrum. As satellite broadcasting becomes more and more prevalent, and it becomes more accessible to the home-owner or individual end-user, it also becomes necessary to produce microwave circuitry for processing the microwave signals received from the satellite, both economically and in substantial quantities. Such microwave circuitry typically employs what are known as microstrip circuits, which form a basic building block for hybrid microwave circuits.

For example, high-frequency amplifiers are typically employed to process the received microwave signals, and circuits must be provided to match the input and output impedances of the semiconductor used as the amplifying element in such high-frequency amplifier. By providing such impedance match, the overall circuit characteristics, such as the noise factor (NF), are improved. Additionally, microstrip circuits are also typically used to provide impedance matched interconnections between various passive components, including resonators and filters, and are used as integral parts of phase shifters, oscillators, and circulators.

One known microstrip circuit, in which the input and output impedances are controlled by adjusting the dimensions of the microstrip circuit, includes a field effect transistor employed as a high-frequency amplifier in a converter for converting super high-frequency (SHF) signals to ultra high-frequency (UHF) signals. As is known, a microstrip is typically formed as a planar structure having a dielectric substrate and conducting strips forming the conductor pattern on one side of the substrate with a conducting ground plane on the other side of the substrate. In order to control the impedances of the micro-strip circuit, it is known to alter the physical dimensions of the conducting strip and, in that regard, one prior practice involves the use of depositing a plurality of small conducting elements appearing substantially as a pattern of dots in the vicinity of various tuning stubs of the microstrip circuit, and then connecting together various ones of the dots in the pattern and to the stub by hand soldering to custom match the impedances of the circuit.

In view of the increasing demand for microstrip circuits and the requirement to mass produce same with a relatively low per-unit cost, the technique of individually adjusting the impedance, as explained above, is not suitable.

OBJECTS AND SUMMARY OF THE INVENTION

Accordingly, it is an object of the present invention to provide an improved microstrip circuit in which the impedance can be adjusted easily and economically.

Another object of the present invention is to provide an improved microstrip circuit in which the impedance can be adjusted in a non-permanent fashion.

In accordance with an aspect of the present invention, a microstrip circuit is provided in which the transmission line is connected to an active circuit element such as a field effect transistor, and in which an additional signal path is connected in parallel to the transmission line to aid impedance matching, and a conductive wire element is connected through the dielectric substrate to the ground plane in the vicinity of the transmission line and additional signal path. This conductive wire element is such that it can be moved at its free end in relation to the signal transmission line to provide a variable impedance. In another aspect of the invention, two such conductive wire elements are provided at the input section of the transmission line to even further control the input impedance of the circuit. The wire element may be coated with an insulating material to prevent the chance of accidental short circuits.

The above and other objects, features, and advantages of the present invention will become apparent from the following detailed description of illustrative embodiments thereof to be read in conjunction with the accompanying drawings.

DETAILED DESCRIPTION OF PREFERRED EMBODIMENT

Figure 1:
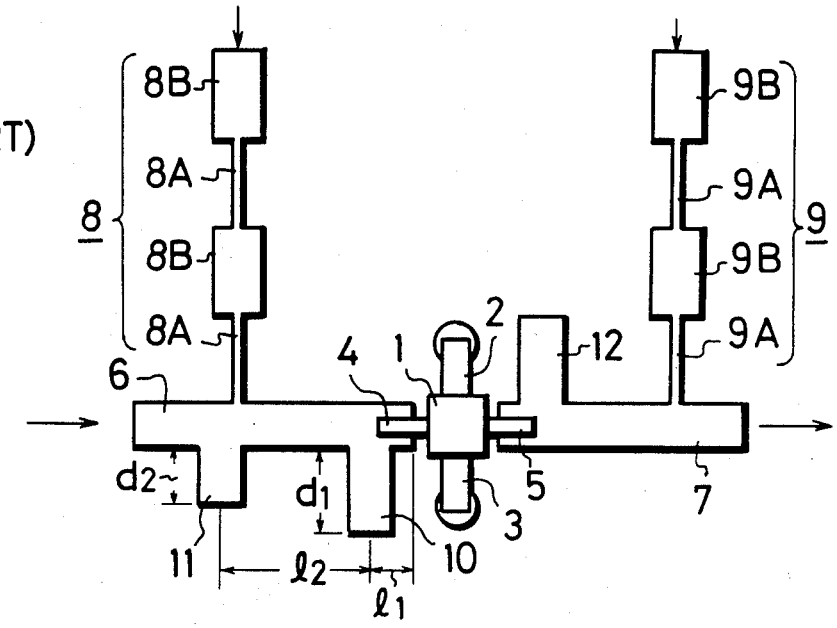
FIG. 1 (PRIOR ART)
FIG. 1 is a schematic representation of a high-frequency amplifier microstrip circuit known in the prior art.

In order to explain a known microstrip circuit reference is made to FIG. 1, which schematically illustrates an example of a prior art microstrip circuit employed as a microwave amplifier. FIG. 1 shows the conducting strip pattern or signal line pattern that would be formed on a dielectric substrate that has a conducting ground plane on the other side thereof, neither the substrate nor the ground plane are shown in FIG. 1. A field effect transistor 1 has its source leads 2 and 3 fed through the dielectric substrate for connection to the ground plane. A gate lead 4 of field effect transistor 1 is connected to a microstrip circuit 6 and a drain lead 5 of field effect transistor 1 is connected to another microstrip circuit 7. Microstrip circuit 6 is connected with a DC return circuit choke pattern 8, which is employed to apply a negative bias voltage to gate lead 4 of field effect transistor 1. Similarly, microstrip circuit 7 is connected with a respective DC return circuit choke pattern 9, which is employed to provide a positive bias voltage to drain circuit 5 of field effect transistor 1.

DC return circuit choke pattern 8 is formed of a series of high-impedance and low-impedance conducting strips and, more specifically, choke pattern 8 is formed having high-impedance line segments 8A, which are of a width determined to be ¼-wave length of the frequency of the signal of interest, and low-impedance line segments 8B, which are relatively wide compared to the high-impedance line segments 8A. A number of these high-impedance lines and low-impedance lines, 8A and 8B, respectively, are alternately connected depending upon the required impedance. Similarly, choke pattern 9 is also formed of high-impedance line segments 9A and low-impedance line segments 9B alternately connected to provide the required output impedance match. Both DC return circuit choke patterns 8 and 9 are dimensioned and constructed so as to present an infinite or open circuit impedance to the frequency of the signal of interest fed to stripline circuits 6 and 7, in order to prevent such signal from being adversely affected by the bias voltages being applied.

Accordingly, an input signal that is supplied through microstrip circuit 6 to gate 4 of field effect transistor 1 is amplified thereby and is fed out from microstrip circuit 7 connected to drain side 5 of field effect transistor 1.

In order to further tune and control the input impedance of the stripline circuit, open-ended stubs 10 and 11 are connected in parallel to the signal transmission line portion 6 to adjust the circuit impedance as seen by gate circuit 4 of field effect transistor 1. Stubs 10 and 11 are open-ended and are in parallel with signal path 6. The lengths $d_1$ and $d_2$ of open-ended stubs 10 and 11, respectively, and their arrangement along strip line 6 at distances $l_1$ and $l_2$, respectively, are determined by the impedance parameters of field effect transistor 1. In other words, the pattern dimensions of the microstrip circuit as seen as in FIG. 1 are determined in order to match the impedance parameters and, once determined, the microstrip circuit is manufactured using conventionally known etching methods.

Figure 2:
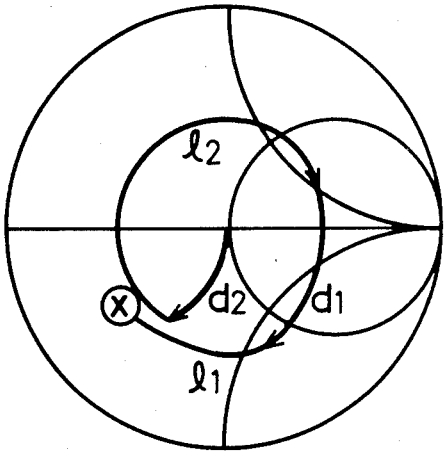
FIG. 2 is a graphical representation of a Smith chart for use in setting the input impedance of a field effect transistor as might be employed in the prior art circuit of FIG. 1.

One known technique for determining such pattern dimensions is the use of a "Smith chart", as represented in FIG. 2. Accordingly, referring to FIG. 2 the impedance of microstrip transmission line 6 is set at an impedance point represented by an encircled X, and the desired impedances can be obtained by determining the respective dimensions $l_1$, $l_2$, $d_1$, and $d_2$ in order to established the relationship as represented in the Smith chart of FIG. 2.

An open-ended stub 12 may also be connected in parallel to the signal transmission line 7 that is connected to drain lead 5 of field effect transistor 1 and the length and arrangement along the transmission line of open-ended stub 12 are similarly determined, in the same fashion as were open-ended stubs 10 and 11. In this fashion, it is known to control or adjust the impedance at the output side of field effect transistor 1.

Nevertheless, even though the pattern dimensions can be determined as above to provide impedances that match the input and output impedances of the microwave semiconductor, because of variations in the real-world characteristics of semiconductors, as well as parametric variations caused when the semiconductor is mounted onto the microcircuit, the actual impedances will quite frequently be moved from the optimum points. Therefore, it is known to be necessary to provide some manner of further adjusting the impedances of the open-ended stubs.

Figure 3:
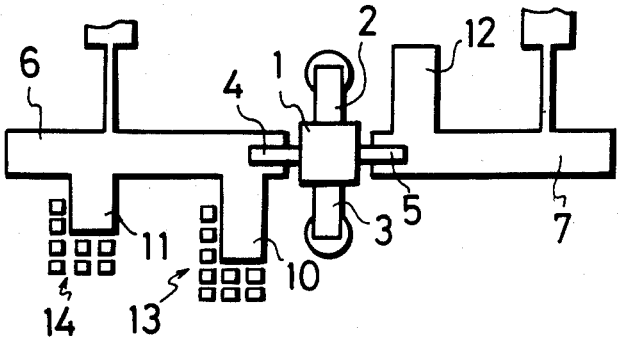
FIG. 3 (PRIOR ART)
FIG. 3 is a schematic representation of a prior art approach to adjusting the impedance of a microstrip amplifying circuit, such as shown in FIG. 1.

It is known in the prior art to provide some impedance adjusting means, such as represented in FIG. 3, in which impedance adjusting patterns 13 and 14 formed of a plurality of conductive elements. These adjusting patterns 13 and 14 are metal conductors of the same material as transmission line 6, for example, and are arranged on the substrate at the open-ends of stubs 10 and 11, so that several of the elements or pieces forming the patterns may be connected together and to the stubs by hand soldering, thereby adjusting the effective lengths $d_1$ and $d_2$ as well as the effective locating distances $l_1$ and $l_2$ of stubs 10 and 11. As might be imagined, this impedance adjusting technique requires troublesome hand labor not suitable for low-cost mass production.

Figure 4:
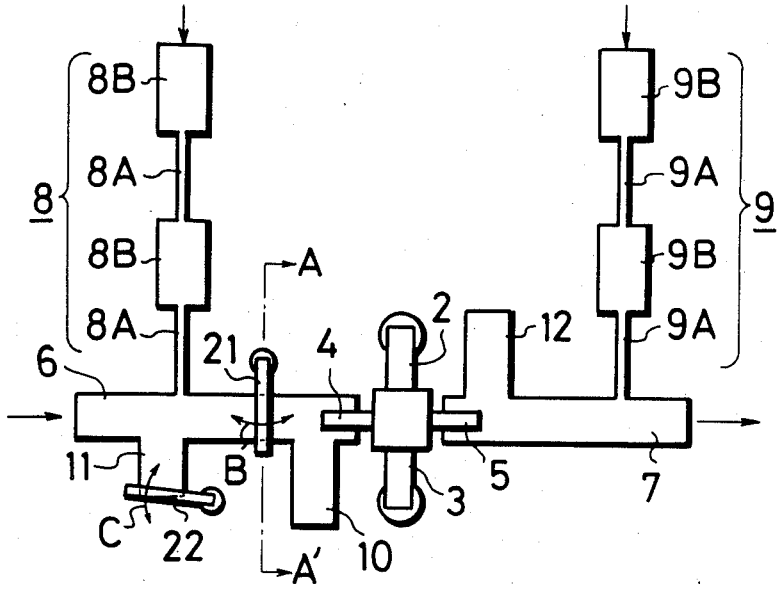
FIG. 4 is a schematic representation of a microstrip circuit according to the present invention.
Figure 5:
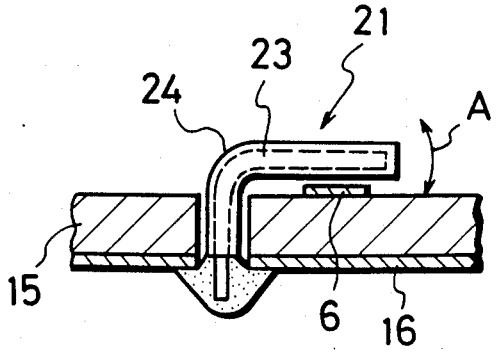
FIG. 5 is cross-sectional view taken along section line A–A′ in the embodiment of FIG. 4.

Turning now to an embodiment of the present invention as shown in FIG. 4, the basic structure of the circuit of FIG. 1 remains, however, according to the present invention adjustable conductive wire elements are provided to accurately control the impedances provided by the transmission line and open-ended stubs. More specifically, conductive wire elements 21 and 22 are provided for impedance adjustment and are respectively arranged near signal transmission line 6 and open-ended stub 11. Both conductive wire elements are formed of substantially the same materials and, as seen more clearly in FIG. 5, which is a cross-sectional view taken through section line A–A′, in FIG. 4, wire element 21 is comprised of an inner, metallic conductive material 23 having a non-conductive sheath 24 arranged therearound. Such insulating cover or sheath 24 can be of Teflon or similar insulating material having a low high-frequency loss. One end of conductive element 21 is bared of its insulating sheath so that inner conductor 23 is exposed and this exposed end is soldered or otherwise electrically connected to the conducting ground plane 16 arranged on the side of the dielectric substrate 15 opposite conducting strip pattern 6. Thus, the orientation of these wire elements 21 and 22 can be freely adjusted, using the soldered end as a supporting point. Accordingly, the distances from wire elements 21 and 22 to signal transmission line 6 and open-ended stub 11, respectively, are made smaller or larger, by movements as shown by arrow A in FIG. 5, or the angular positions at which wire elements 21 and 22 intersect the signal transmission line 6 and open-ended stub 11, respectively can be changed by movements in the directions represented by arrows B and C, respectively, in FIG. 4. Thus, if wire elements 21 and 22 are arranged to be closer to transmission line 6 and open-ended stub 11, a parallel capacitance is added to transmission line 6 and open-ended stub 11, so that the effective length of each line can be changed equivalently, thereby carrying out an input impedance adjustment.

Unlike the known prior art approach, because metallic wire elements 23 are covered with insulating sheath 24 there is no possibility that the transmission line pattern can be short accidentally circuited to ground.

Although the present invention is described in regard to a high-frequency amplifier circuit, the impedance adjusting provisions taught thereby need not be limited to such high-frequency use but can be applied to any of the other uses for microstrip circuits. Such other uses might comprise, for example, a mixer circuit utilized in a super high-frequency to ultra high-frequency converter, impedance adjustment at the output side of a local oscillator circuit, or the impedance matching adjustment of a circulator. Note also that the impedance adjusting device need not be employed with each and every open-ended stub in the circuit but can be employed as necessary to provide the appropriate impedance matching adjustment.

Therefore, in accordance with the teaching of the present invention because the impedance adjustment can be carried out simply by moving the free end of the conductive wire element, the other end of which is attached to the conductive ground plane of the microstrip circuit, and by providing such impedance adjusting element in proximity to the signal transmission line or impedance stub one need only change the spatial positions of the wire element relative to the signal transmission line or the open-ended stub in order to perform impedance adjustment, and the bothersome and inefficient steps, such as soldering elements of the adjusting pattern, need not be performed. Thus, the present invention is specifically adapted for low-cost mass production. That is, the impedance adjustment, or adjustment of the input/output voltage standing wave ratio (VSWR), of a high-frequency microstrip amplifier can be easily performed and the burdensome steps known in the prior art eliminated.

Having specifically described illustrative embodiments of the invention with reference to the accompanying drawings, it is to be understood that the invention is not limited to those precise embodiments and that various changes and modifications may be effected therein by one skilled in the art without departing from the scope and spirit of the invention as defined in the appended claims.

What is claimed is:

1. A microstrip circuit comprising:

a signal transmission line;

a circuit element connected at one end to said signal transmission line;

an impedance matching element connected in parallel to said signal transmission line; and an electrically conductive wire element having one end connected to ground potential and arranged in proximity to at least one of said signal transmission line and said impedance matching element and being arranged for free movement in space above said transmission line and said impedance matching element with said one end taken as a supporting point, whereby a spatial position of said conductive wire element relative to one of said signal transmission line and said impedance matching element is varied to vary an effective impedance of said signal transmission line relative to said circuit element.

2. A microstrip circuit according to claim 1, in which said conductive wire element is arranged adjacent said signal transmission line.

3. A microstrip circuit claim 1, in which said conductive wire material is arranged adjacent said impedance matching element.

4. A microstrip circuit according to claim 1, in which said conductive wire element is formed of an electrically conductive metal wire covered by an insulating sheath.

5. A microstrip circuit according to claim 4, in which said conductive metal wire is grounded at its one end by a solder connection to a ground plane included in said microstrip circuit.

6. Apparatus for adjusting the impedance of a microstrip circuit of the kind having a signal transmission line connected at one end to a circuit element, comprising:

a stripline element connected in parallel to said signal transmission line and being open-ended; and a conductive wire element having one end connected to ground potential and arranged in proximity to one of said signal transmission line and said stripline element, said conductive wire element being arranged for freely moving in space above said one of said transmission line and said stripline element with said one end taken as a supporting point, in which a spatial position of said conductive wire element relative to one of said signal transmission line and said stripline element is varied so as to vary an effective impedance of said signal transmission line relative to said circuit element.

7. A microstrip according to claim 6, in which said conductive wire element is arranged adjacent said signal transmission line.

8. A microstrip circuit according to claim 6, in which said conductive wire material is arranged adjacent said parallel-connected stripline element.

9. A microstrip circuit according to claim 6, in which said conductive wire element is formed of a conductive metal wire and an insulating sheath arranged to cover said conductive wire.

10. A microstrip circuit according to claim 9, in which said conductive metal wire is grounded at its one end to a ground plane included in said microstrip circuit by means of a solder joint.

11. Apparatus for adjusting the impedance of a microstrip circuit of the kind employing at least one circuit element, a signal transmission line connected at one end to the circuit element, and an impedance matching element connected in parallel to the signal transmission line, comprising:

a conductive wire element arranged in proximity to one of said signal transmission line and said impedance matching element, said conductive wire element having one end connected to relative electrical ground potential and being capable of freely moving in space above said transmission line and said impedance matching element with said one end taken as a supporting point, in which a spatial position of said conductive wire element relative to one of said signal transmission line and said impedance matching element is varied to vary an effective impedance of said signal transmission line relative to said circuit element.

12. A microstrip circuit according to claim 11, in which said conductive wire element is adjacent said signal transmission line.

13. A microstrip circuit according to claim 12, further comprising a second conductive wire element arranged adjacent said impedance matching element.

14. A microstrip circuit according to claim 13, in which first and second conductive wire elements are formed of conductive metal wire and an insulating sheath covering exposed surfaces of said conductive wire.

15. A microstrip circuit according to claim 14, in which said first and second conductive wire elements are grounded at their respective one ends by solder joints to a ground plane included in said microstrip circuit.

* * * * *